US010705465B2

(12) United States Patent
Hirst et al.

(10) Patent No.: US 10,705,465 B2
(45) Date of Patent: Jul. 7, 2020

(54) DETERMINING MEDIA WEIGHT BASED ON INPUT VOLTAGE ESTIMATE

(71) Applicant: Hewlett-Packard Development Company, L.P., Spring, TX (US)

(72) Inventors: Bartley Mark Hirst, Boise, ID (US); Mark Shaw, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/462,703

(22) PCT Filed: Jan. 25, 2017

(86) PCT No.: PCT/US2017/014900

§ 371 (c)(1),
(2) Date: May 21, 2019

(87) PCT Pub. No.: WO2018/140002

PCT Pub. Date: Aug. 2, 2018

(65) Prior Publication Data

US 2019/0302668 A1 Oct. 3, 2019

(51) Int. Cl.
*G03G 15/00* (2006.01)
*G03G 15/20* (2006.01)

(52) U.S. Cl.
CPC ..... *G03G 15/5029* (2013.01); *G03G 15/2046* (2013.01); *G03G 2215/00742* (2013.01)

(58) Field of Classification Search
CPC ..... G03G 15/5029; G03G 15/2046; G03G 2215/00742
See application file for complete search history.

(56) References Cited

U.S. PATENT DOCUMENTS

| | | | | |
|---|---|---|---|---|
| 6,804,478 | B2 | 10/2004 | Martin et al. | |
| 8,126,347 | B2 | 2/2012 | Kladias et al. | |
| 9,128,438 | B2 | 9/2015 | Atay et al. | |
| 2004/0223777 | A1 | 11/2004 | Cao et al. | |
| 2008/0298860 | A1 | 12/2008 | Omata | |
| 2010/0021194 | A1* | 1/2010 | Toyohara | G03G 13/20 399/69 |
| 2013/0209145 | A1* | 8/2013 | Hasegawa | G03G 15/2053 399/328 |

(Continued)

FOREIGN PATENT DOCUMENTS

| | | |
|---|---|---|
| CN | 104049507 B | 9/2014 |
| EP | 1927034 B1 | 12/2012 |
| JP | 2014071431 | 4/2014 |

OTHER PUBLICATIONS

Tse M et al., A Fusing Apparatus for Toner Development and Quality Control, IS&T's NIP13 ~ Nov. 1997 ~ 5 pages.

*Primary Examiner* — Carla J Therrien
(74) *Attorney, Agent, or Firm* — Fabian VanCott

(57) ABSTRACT

In one example in accordance with the present disclosure, a method for determining fusing energy per page based on an applied voltage is described. According to the method, a resistance of a fusing system is acquired and an input voltage of a fusing system is estimated. A duty ratio of the fusing system is measured and a fusing energy per processed page is then determined based on the input voltage, the fusing system resistance, and the duty ratio of the fusing system. A media weight is then determined based on the fusing energy per processed page.

15 Claims, 4 Drawing Sheets

(56) References Cited

U.S. PATENT DOCUMENTS

| | | | | |
|---|---|---|---|---|
| 2013/0272732 | A1* | 10/2013 | Sato | G03G 15/2039 399/44 |
| 2014/0270868 | A1 | 9/2014 | Chiyoda et al. | |
| 2017/0038710 | A1* | 2/2017 | Tamura | G03G 15/5029 |
| 2017/0090395 | A1* | 3/2017 | Shimura | G03G 15/80 |

* cited by examiner

DETERMINING MEDIA WEIGHT BASED ON INPUT VOLTAGE ESTIMATE

BACKGROUND

Some imaging devices, such as electro-photographic printers form printed marks, such as texts and images, on media by depositing a printing compound, such as toner or ink, onto the media. After application of the printing compound, a fusing system applies heat and pressure to the printing compound and the media.

BRIEF DESCRIPTION OF THE DRAWINGS

The accompanying drawings illustrate various examples of the principles described herein and are part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
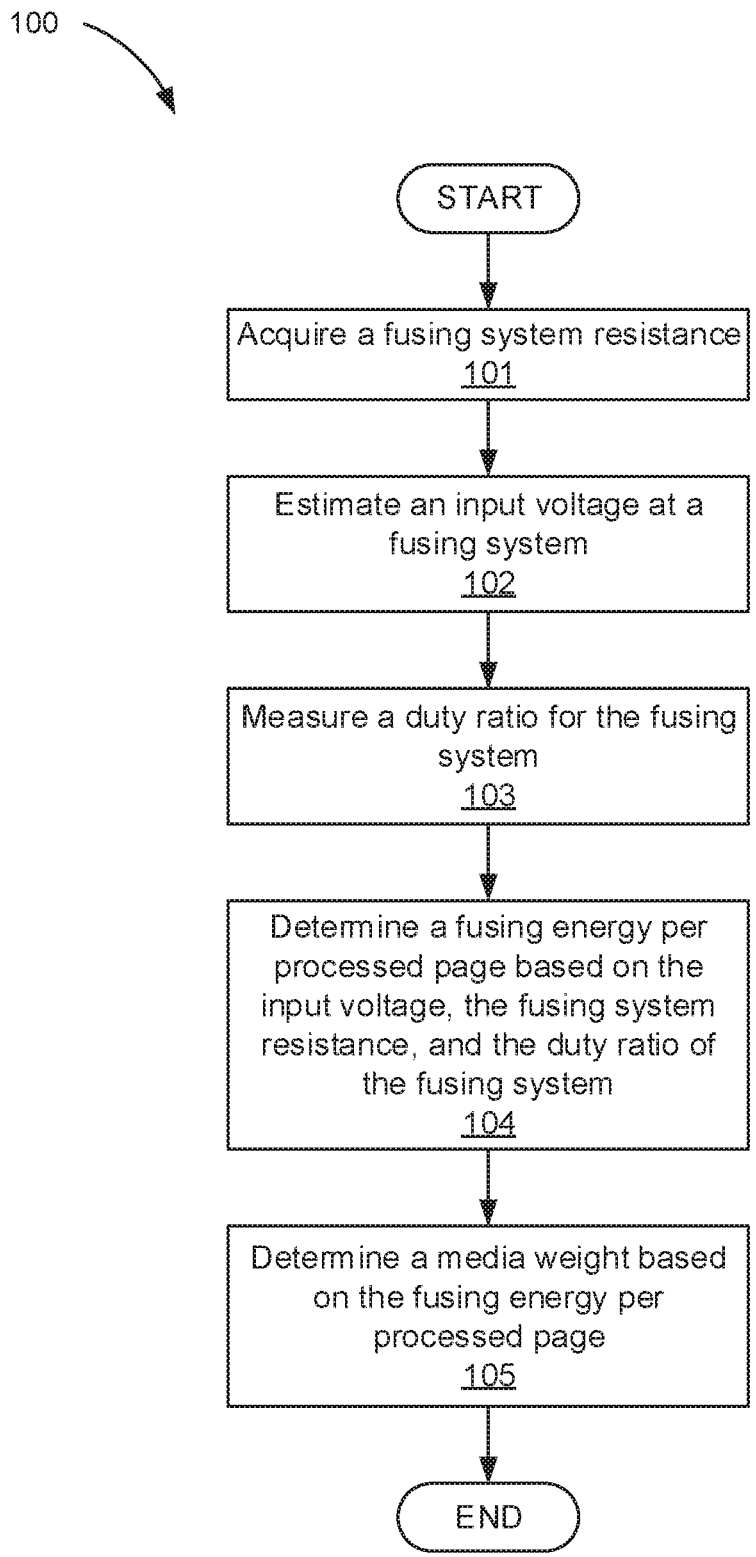
FIG. 1 is a flowchart of a method for determining media weight based on an estimate of a fusing system input voltage, according to an example of the principles described herein.

Some imaging devices, such as electro-photographic printers form printed marks, such as texts and images, on media by depositing a printing compound, such as toner or ink, onto the media. After application, a fusing system applies heat and pressure to the printing compound and the media.

The fusing system in such imaging devices can include a pair of rollers, specifically a fuser roller and a pressure roller. The fuser roller is directly heated, for example by an internal heater. The fusing system can be used in dry electro-photographic print/copy systems and wet photographic print/copy systems.

In a dry electro-photographic process, dry toner is applied to a media surface. The toner is in the form of a thermoplastic, which may be based on styrene, styrene-polyester blends, or polyester. In some examples, the type or blend ratio of the thermoplastic is tailored to the specific operating temperatures of the print/copy system and other criteria. In a dry electro-photographic process, the thermoplastic is deposited on the media. The fuser roller then applies heat to the toner/media combination to facilitate bonding of the toner to the media. The pressure roller is not directly heated, but is indirectly heated from contact with the fuser roller. The pressure roller presses against the fuser roller to form a nip. Pressure at the nip facilitates media-toner bonding as the toner is melted and fused to the media by the pressure exerted on it by the fuser roller and the pressure roller. After passing through the nip, the toner is bonded to the media and the media with toner is passed to a discharge tray or another section of the printer.

In a wet photographic process, which may be referred to as an inkjet process, the fusing system conditions the ink/media after the ink has been applied on the surface of the media. For example, in inkjet processes where a significant amount of water-based ink is applied to the media, the media can become very wet. In such a wet state, the media no longer has sufficient beam strength to withstand the forces and stresses of transitioning through the various rollers and media conveyance mechanisms of the print system. In this weakened state, the media may become damaged or may jam up the conveyance mechanisms. Jamming can lead to costly field service to restore the system to operation.

To condition such a wet photographic process, the fusing system heats up the wet media to above the boiling point of water, for example up to 170 degrees C. This causes the excess moisture to quickly evaporate off the media to enhance the beam strength of the media so that it can then travel through the balance of the paper handling system at high speed reducing the risk of media damage and jamming. While the present specification may refer to specific examples of a dry electro-photographic process or an inkjet process, the methods and systems described herein may be used in either system, i.e., a dry electro-photographic imaging device and/or an inkjet imaging device.

While allowing a printing compound to be applied onto media to form printed marks such as text and images, the operation of such imaging devices can benefit from increased functionality and technical innovation. For example, the media that may be fed into an imaging device may have different weights. The weight of a media refers to the weight, in pounds, of 500 sheets of the media. Examples of different media weights include 16 weight, 20 weight, 24 weight, 28 weight, and 32 weight. Different weight media respond differently to an applied pressure and temperature and therefore the parameters of the fusing system should be adjusted based on the particular media weight being processed to ensure optimal quality.

Accordingly, some imaging devices use controllers to specify the media being processed. However, such devices may not be accurate in specifying the type of media being processed. For example, some imaging devices rely on user selection of a media type to be processed. However, such user input can be wrong, as users may not be knowledgeable about the weight of paper. Moreover, as media having a particular weight is switched out for media having a different weight, a user may not adjust the settings of the imaging device to accommodate the different media weight.

An incorrect specification of the media weight could lead to complications with the printing process. For example, if the fusing temperature is set too high, for example in the case of media weight 32 being specified when media weight 16 is actually being processed, the media can wrap around the fuser roller resulting in a wrap jam. More specifically, if the lighter weight media is processed in a dry electro-photographic system and has a high toner coverage, the molten toner can adhere to the hot fuser roller. The light media has lower beam strength to force a physical separation of the media/toner from the fuser, and the media may remain temporarily attached the fuser roller as it rotates, resulting in a wrap jam.

Conversely, if heavier media, for example 32 weight media, is installed when a lighter weight media is specified, then the toner may be insufficiently melted and may not fuse with the media. This could result in toner that is easily removed from the media through mechanical action. Other defects may result as well. One such other defect is referred to as "cold offset" where toner is picked off the media surface by the fuser roller and then, after additional rotations of the fuser roller, may become sufficiently molten to then fuse with the media in an undesired location.

Some efforts have been made to determine a media weight, but resulting systems often implement additional hardware components, thus increasing technical complexity, which technical complexity complicates their use and repair. Moreover, such additional sensors and complex weight detecting systems can be expensive.

Accordingly, the present specification describes methods and systems that address these and other issues. Specifically, the present specification describes determining media weight using existing sensors within a system. Specifically, a fuser power is calculated by estimating a voltage applied to a fusing system and considering this voltage in view of the fusing system resistance and a duty ratio of the fusing system. Using the fuser power, a fusing energy per processed page can be determined and a media weight calculated based on the determined energy per processed page. With the media weight identified, an operation of an imaging device can be automatically adjusted to optimize the printing process to increase the quality of the printed mark. For example, proper fusing relies on three variables, 1) time in the nip where fusing occurs, 2) fusing temperature, and 3) fusing pressure. Accordingly, adjustment of the fusing process can include changing the fusing temperature, changing the rate of printing, and/or changing the pressure between the fuser roller and the pressure roller.

Specifically, the present specification describes a method for determining a fusing energy per page from which media weight can be determined and on which an adjustment of the imaging operation is based. According to the method, a fusing system resistance is acquired, and an estimate of an input voltage for the fusing system is determined. A duty ratio for the fusing system can also be measured. Based on the input voltage, the fusing system resistance, and the duty ratio of the fusing system, a fusing energy per processed page is determined. A media weight can then be determined based on the fusing energy per processed page.

The present specification also describes an imaging system that includes a printing device to deposit a printing compound on a media surface. The imaging system also includes a fusing system to heat the printing compound and the media. A media weight determining system of the imaging system includes an estimate engine to estimate a fusing system input voltage. A resistance engine of the media weight determining system acquires a fusing system resistance and a duty ratio engine of the system measures a duty ratio of the fusing system. A fusing energy engine of the media weight determining system determines a fusing energy per processed page based on the input voltage, the fusing system resistance, and the duty ratio of the fusing system. A media weight engine of the media weight determining system determines a media weight based on the fusing energy per processed page.

The present specification also describes a computer system that includes a processor and a machine-readable storage medium coupled to the processor. An instruction set is stored in the machine-readable storage medium and is to be executed by the processor. The instruction set includes instructions to measure a fusing system resistance, instructions to estimate a fusing system input voltage based on a portion of power passed to the fusing system and a rate of change of temperature of the fusing system, and instructions to measure a duty ratio of the fusing system. The instruction set also includes instructions to obtain an initial temperature of the fusing system. The instruction set also includes instructions to determine a fusing energy per processed page based on the input voltage, the fusing system resistance, the duty ratio of the fusing system, and the initial temperature of the fusing system. The instruction set also includes instructions to determine a media weight based on the fusing energy per processed page and to adjust an operation of a fusing system based on the determined media weight.

In one example, using such a media weight determining tool 1) determines media weight using existing sensors and control systems: 2) reduces the cost of media weight determination; 3) facilitates accurate media weight determination across a variety of printer models; 4) determines media weight at a faster rate; 5) minimizes energy consumption by providing fusing parameters tailored to the specific media weight present; 6) reduces the propensity of media wrap jams around the fuser roller; 7) reduces warranty expense resulting from complications arising from incorrect media weight measurements; 8) ensure proper configuration of imaging systems to accommodate an actual media weight processed, even in light of incorrect user indication; and 9) facilitates media weight determination at full printing speed. However, it is contemplated that the devices disclosed herein may address other matters and deficiencies in a number of technical areas.

As used in the present specification and in the appended claims, the term "printed mark" refers to a glyph, text, or image that is formed on media by depositing a print fluid such as ink or a pigment particle such as toner in a pattern representative of the mark.

Further, as used in the present specification and in the appended claims, the term "duty ratio" refers to a measurement of the supplied power to a fusing system. The duty ratio is based on the voltage supplied to the fusing system, the resistance of the fusing system, and a predetermined percentage of the possible power used by the fusing system.

Still further, as used in the present specification and in the appended claims, the term "imaging" refers to any operation that forms a printed mark such as an image or text on media. Examples of such operations include printing, and copying. Accordingly, imaging devices can include electrophotographic printers, inkjet printers, electrophotographic copiers, inkjet copiers, facsimile machines and the like.

Even further, as used in the present specification and in the appended claims, the term "printing compound" refers to any compound that forms printed marks on media. Examples of printing compounds include toner used in a dry imaging operation and ink used in a wet imaging operation.

Even further, as used in the present specification and in the appended claims, the term "a number of" or similar language is meant to be understood broadly as any positive number including 1 to infinity.

Figure 3:
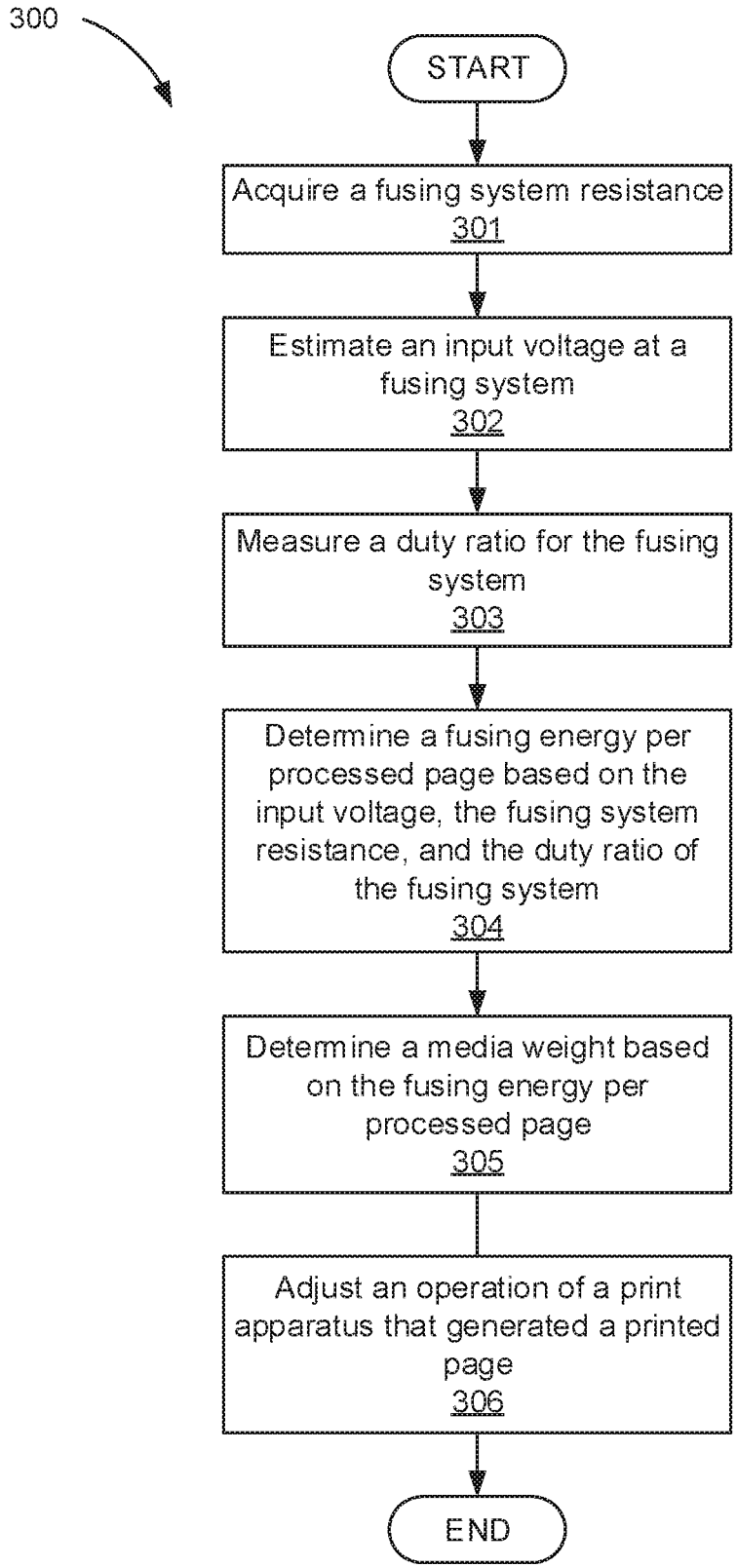
FIG. 3 is a flowchart of a method for determining media weight based on an estimate of a fusing system input voltage, according to another example of the principles described herein.

FIG. 1 is a flowchart of a method (100) for determining media weight based on an estimate of a fusing system input voltage, according to an example of the principles described herein. As a general note, the methods (100, 300) may be described below as being executed or performed by at least one device, for example, a computing device. Other suitable systems and/or computing devices may be used as well. The methods (100, 300) may be implemented in the form of executable instructions stored on at least one machine-readable storage medium of at least one of the devices and executed by at least one processor of at least one of the devices. In one implementation, the machine-readable storage medium may include a standalone program installed on the device. In another implementation, the machine-readable medium may include instructions delivered by a browser on the device. Alternatively or in addition, the methods (100, 300) may be implemented in the form of electronic circuitry (e.g., hardware). While FIGS. 1 and 3 depict operations occurring in a particular order, a number of the operations of the methods (100, 300) may be executed concurrently or in a different order than shown in FIGS. 1 and 3. In some examples, the methods (100, 300) may include more or fewer operations than are shown in FIGS. 1 and 3. In some examples, a number of the operations of the methods (100, 300) may, at certain times, be ongoing and/or may repeat.

According to the method (100), a fusing system resistance is acquired (block 101). The fusing system resistance refers to the electrical resistance of the fuser roller-heating element. For example, some imaging systems use a constant resistance heating element that is printed onto a ceramic substrate and then covered with a thin glass layer. In some examples, the fusing system resistance may be acquired (block 101) by retrieving it from a memory storage device. More specifically, the imaging device in which the fusing system is installed, or a consumable that is used with the imaging device, may include a memory storage device. The fusing system resistance can be stored in these memory storage devices and can be read by the imaging device.

Using the fusing system resistance, an estimate of the fusing system input voltage is estimated (block 102). In some examples, the input voltage is estimated based on the resistance of the fusing system and a fusing system temperature gradient. In general, the temperature response of a fusing system has a linear relationship over time with the power that is applied to the fusing system. Accordingly, by applying a predetermined power to the fusing system, and by analyzing the temperature response, an estimation of the input voltage can be determined. For certain temperatures, the relationship of the temperature response and power may be exponential; however, the imaging device of the present specification includes a temperature control loop to maintain the fusing system within a desired temperature range, which temperature range holds to the linear relationship described above.

Accordingly, to estimate an input voltage, a predetermined power, i.e., in accordance with a predetermined duty ratio, can be applied to the fusing system. This can be done by forcing the power electronics of the fuser power control system to a fixed duty ratio. The duty ratio could be fixed at 0.25 for example, which would give a longer warm-up period and lower temperature slope to estimate the input voltage. As another example, the duty ratio could be fixed at 1.0 to more quickly warm-up the fuser system and more quickly obtain an estimate of the input voltage to which the imaging system is attached. As noted above, the duty ratio can be presented as the ratio of the time that power is actually applied to the fuser versus the total time that power could be applied to the fuser. It can also be expressed as the ratio of the average power that is applied to the fuser verses the total power that could be applied to the fuser.

The temperature response of the fusing system over time can then be measured. In general, the temperature response, m, can be expressed as a function of the input voltage, V and the resistance of the fusing system, $R_{fuser}$, as expressed in Equation (1) below.

$$m \propto \frac{V^2}{R_{fuser}} \qquad \text{Equation (1)}$$

From Equation (1) it can be seen that there is a proportional relationship between the different parameters such that having measured the temperature response, m, A processor, for example, a processor in the imaging system can rely on this relationship and solve Equation (1) for V, such that an input voltage, V, can be estimated from the resistance of the fusing system, $R_{fuser}$, and the temperature response m.

In another example, a fusing system warmup time can be used to estimate the input voltage. Specifically, the warmup time may refer to the time it takes the fusing system to increase from one predetermined temperature to another predetermined temperature. This warmup time as also proportional to the input voltage. Accordingly, using the warmup time, duty ratio, and resistance of the fusing system, an input voltage can be estimated.

In both these examples, an estimate, not a measurement, of the AC input voltage can be made. Estimating (block 102) the voltage allows for media weight determination at a higher rate as the voltage is not actually calculated but estimated. In other words, the printing operations are not slowed down to get such an estimate. Moreover, estimating (block 102) is more cost effective as it does not rely on complex and expensive sensors to determine an input voltage.

A duty ratio for the fusing system can then be measured (block 103). The duty ratio is the output of the fuser temperature control loop and varies between 0.00 and 1.00 in a continuous manner during imaging operations. In some examples, a longer-term time average of the duty ratio over several processed pages may be desirable. Accordingly, an average duty ratio value is used to estimate the average power per processed page and then further used to estimate the media weight. Note that the duty ratio measured is distinct from the applied duty ratio to estimate (block 102) the input voltage. As noted above, the duty ratio of the fusing system refers to the amount of power applied to the fusing system. The duty ratio of a fusing system increases for heavier media. This is because the heavier media has a higher thermal mass and draws more power for proper operation of the fusing system. In some examples, the duty ratio is measured (block 103) over a period of time to determine an average value. Such a period of time may be 5 pages, for example.

The duty ratio itself can change with input voltage and the fuser resistance for a given constant fuser power target and for a given media weight. Because of this multi-variable response, the duty ratio alone may not be sufficient to determine media weight, unless one has an accurate estimate of the input voltage as well as an indication of the fuser heater resistance. Further to this point, the duty ratio may decrease as the fusing system warms up to an operating temperature. For example, initially, the duty ratio may be 1.0, i.e., a maximum value, for the first 5 seconds to force maximum energy into the fuser and then the duty ratio decreases as the fuser achieves operating temperature and may then stabilize at, for example, 0.25, during continuous printing for a given input voltage, fuser resistance, and media weight.

From this information, a fusing energy per processed page can be determined (block 104). The fusing energy per processed page refers to the power consumed by the fusing system in treating the printing compound and a particular page. As noted above, conditioning the printing compound/media can include fusing the toner to media and heating ink to cause excess moisture to evaporate from off the media. Specifically, a processor, such as a processor in a computing system in which the fusing system is disposed, can calculate the fusing energy per page, in joules, by relying on Equation (2).

$$\text{Energy/page} = \frac{V^2}{R_{fuser}} \times d_{average} \times \text{time/pages} \quad \text{Equation (2)}$$

In Equation (2) above, V refers to the estimate of the input voltage, $R_{fuser}$ refers to the fusing system resistance, $d_{average}$ refers to the average duty ratio of the fuser power controller over the measurement interval, pages is the page count over the measurement interval, and time is the elapsed time in seconds over the measurement interval.

From Equation (2), a processor of a computing system determines a fusing energy per processed page. Given that the pages variable and the time variable are values over time, the fusing energy per processed page can be an average fusing energy per processed page over the predetermined period of time.

In some examples, the fusing energy per processed page can be based on environmental conditions, such as an initial fuser temperature and relative humidity. The reliance on environmental conditions when determining fusing energy per processed page may increase the accuracy of media weight determination. Specifically, some of the power applied to the fusing system may be diverted to heat the thermal mass of the fusing system. Therefore, the initial conditions may impact the amount of energy supplied that is used to condition the printing compound/media combination. Accordingly, knowing the initial conditions allows for a determination of fusing energy per page to be more accurate. Additionally, accounting for initial conditions may render the estimate (block 102) of input voltage more accurate as well as affecting the time period over which average power per page is determined.

Using the fuser temperature obtained just before printing on an unknown media and the energy/page estimation obtained using Equation (1), the media weight can be determined (block 104). Specifically, a memory storage device may reside in the imaging device, or a consumable used by the imaging device. This memory storage device may include a lookup table, or multiple lookup tables that are indexed based on the initial fusing system conditions, such as an initial temperature. These lookup tables correlate fusing energy per page to a media weight. Accordingly, with a determination of fusing energy per processed page, the lookup table could be consulted and, considering the initial fusing system temperature, a proper media weight selected. In some examples, the above-described method (100) is carried out as an associated imaging device is operating at full speed, such that the device does not have to slow down in order to determine media weight. Performing the method (100) while printing at full speed facilitates a non-intrusive production of a printed product.

The above-described method (100) provides for efficient and effect media weight determination. That is, the method (100) above does not rely on any specific media weight sensors, which sensors can be expensive, and technically complex to implement. Rather, the method (100) above may rely on components that already exist in a given imaging device.

Moreover, the accurate media weight determination described above allows for optimization of the fusing system. That is, proper fusing for media having a particular weight may be carried out at lowest energy use. More specifically, some imaging systems use a high fusing energy, regardless of the media weight, in order to ensure proper fusing. However, such a system may use a higher fusing temperature than necessary, which increases production costs, reduces efficiency as more power than is needed is drawn, and potentially reduces the life of the fuser roller by exposing it to a greater thermal load than necessary.

Moreover, by merely estimating, and not measuring, an input voltage, a quicker and more efficient measure of media weight may be made. That is, measuring an input voltage may be more costly and may implement complex sensors. Estimating (block 102) the input voltage alleviates the use of such complex sensors, thus improving technical efficiency of the media weight determination.

Still further, the above method (100) improves technical performance. For example, in a dry electro-photographic imaging device, using a fusing temperature that is too low can degrade the quality of a job as toner is not properly fused to the media and as a result, the toner may wipe off. By comparison, if the fuser temperature is too hot, the toner can become very molten, such that it sticks to the fuser roller and leads to wrap jams where the media wraps around the fuser roller. Other examples of complications that can arise include toner not attaching to media, toner partially attached to the fuser roller and partially attached to the media. Each of these issues can lead to toner being disposed somewhere else on the media. All these technical complications lead to a less effective and less productive toner fusing system. In an inkjet imaging device, temperatures that are too low may not sufficiently evaporate excess fluid such that a target beam strength is not achieved and too much temperature may otherwise adversely impact product quality. Accordingly, by providing for a quick, and accurate determination of media weight, notwithstanding user error, proper operation of the fusing system is ensured, thus ensuring the quality of the imaging device.

Figure 2:
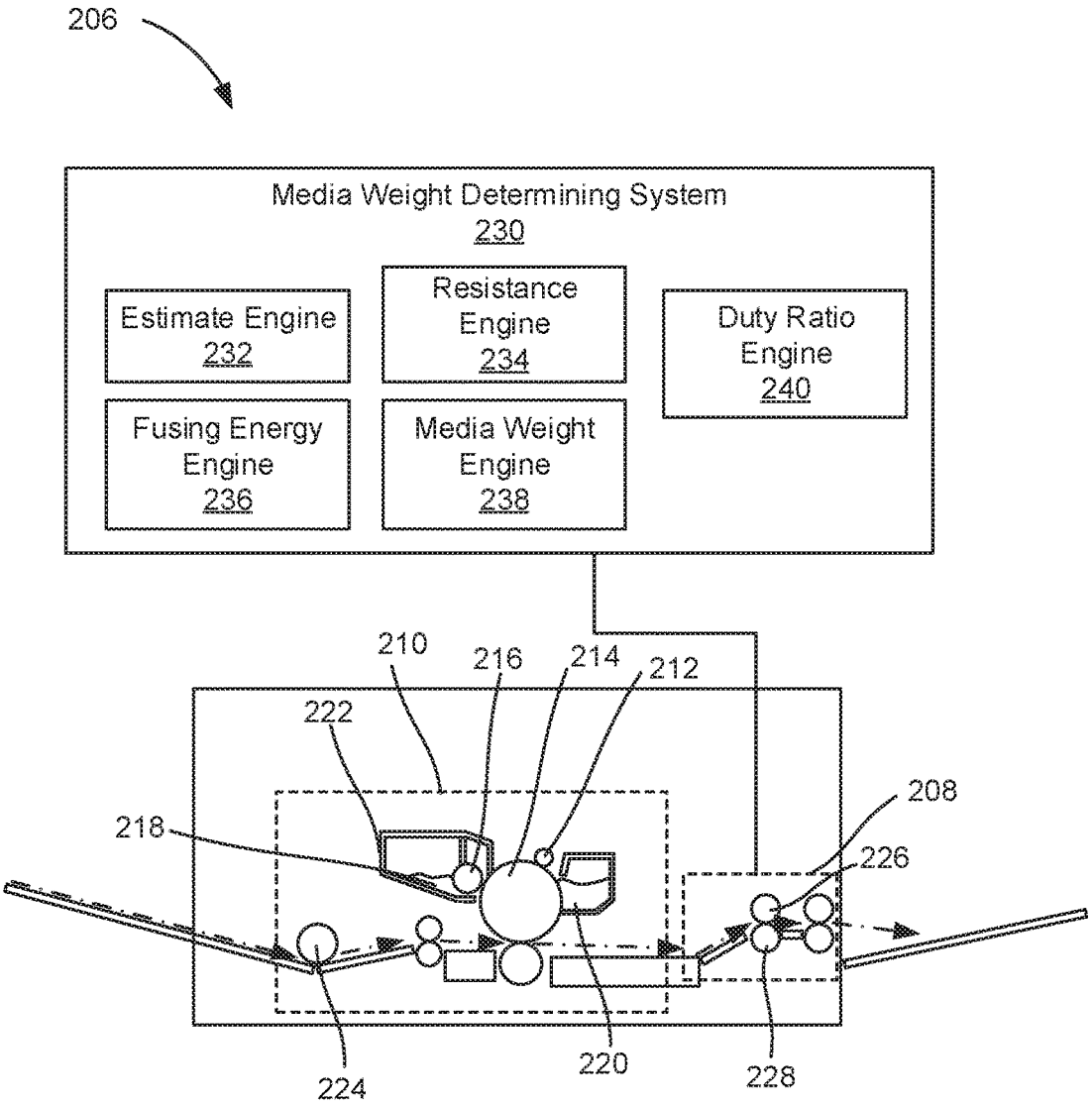
FIG. 2 is a diagram of an imaging system for printing and determining media weight based on an estimate of an input voltage to a fusing system of the printing system, according to an example of the principles described herein.

FIG. 2 is a diagram of an imaging system (206) for printing and determining media weight based on an estimate of a fusing system (208) input voltage, according to an example of the principles described herein. In some examples, the imaging system (206) includes an imaging device (210) to form printed marks on media. The imaging device (210) may be an inkjet device that deposits fluid ink onto a media surface. In another example, the imaging device (210) is a dry electro-photographic imaging device that deposits toner on a media surface. While specific reference is made to a dry electro-photographic imaging device (210), the principles described herein apply as well to an inkjet imaging device.

In some examples, the imaging device (210) includes a charge roller (212) that is used to charge the surface of a photoconductor drum (214). A laser diode (not shown) is provided that emits a laser beam, which is pulsed on and off as it is swept across the surface of the photoconductor drum (214) to selectively discharge the surface of the photoconductor drum (214). In the orientation shown in FIG. 2, the photoconductor drum (214) rotates in the counterclockwise direction. A developing roller (216) is used to develop a latent electrostatic image on the surface of the photoconductor drum (214) after the surface voltage of the photoconductor drum (214) has been selectively discharged. Toner (218) is stored in a toner reservoir (222) of an electrophotographic cartridge. The developing roller (216) includes an internal magnet that magnetically attracts the toner (218) from the cartridge to the surface of the developing roller (216). As the developing roller (216) rotates (clockwise in FIG. 2), the toner (218) is attracted to the surface of the developing roller (216) and is then transferred across the gap between the surface of the photoconductor drum (214) and the surface of the developing roller (216) to develop the latent electrostatic image.

Media, for instance sheets of paper, are loaded from an input tray by a pickup roller (224) into a conveyance path indicated by the dash-dot line in FIG. 2. The media is drawn through the imaging device (210) by drive rollers such that the leading edge of each media is synchronized with the rotation of the region on the surface of the photoconductor drum (214) that includes the latent electrostatic image. As the photoconductor drum (214) rotates, the toner (218) adhered to the discharged areas of the photoconductor drum (214) contact the media, which has been charged by a transfer roller such that the medium attracts the toner particles away from the surface of the photoconductor drum (214) and onto the surface of the media. As some toner may remain on the surface of the photoconductor drum (214), a cleaning blade removes the adhered particles, which are deposited in a toner waste hopper (220).

As the media continues along the conveyance path, the media is delivered to a fusing system (208). The media passes between a fuser roller (226) and a pressure roller (228). As described above, the fuser roller (226) is heated such that the nip between the fuser roller (226) and the pressure roller (226) exposes the media to high heat and pressure that fuses the toner to the surface of the media. When the imaging device is an inkjet imaging device, the heat and pressure cause excess moisture from the fluid ink to evaporate, thus restoring the beam strength to the media.

In some examples, the fuser roller (226) and pressure roller (238) are formed as hollow tubes constructed out of a material such as aluminum or steel. Each roller (226, 228) has an outer layer that is formed of an elastomeric material such as silicon rubber or a flexible thermoplastic. This flexible outer layer allows the fuser roller (226) and pressure roller (228) to compress together to increase the width of the nip, which increases the time that the media resides at the nip. When the print compound is toner, the longer the dwell time in the nip, the larger the total energy that the toner and recording medium can absorb to melt the toner. Within the nip, the toner is melted and fused to the media by the pressure exerted on it by the fuser roller (226) and the pressure roller (228). After the toner has been bonded to the surface of the media, the media is forwarded by a discharge roller to a discharge tray.

As described above, the fuser roller (226) may be heated, which can be accomplished via a high-power tungsten filament quartz lamp inside the hollow fuser roller (226). The heat generated diffuses to the outer surface of the fuser roller (226) until it reaches a temperature sufficient to melt the toner or evaporate the excess moisture from the ink.

The imaging system (206) also includes a media weight determining system (230) to determine the weight of processed media. To achieve its desired functionality, the media weight determining system (230) includes various hardware components. Specifically, the media weight determining system (230) includes a number of engines. The engines refer to a combination of hardware and program instructions to perform a designated function. The engines may be hardware. For example, the engines may be implemented in the form of electronic circuitry (e.g., hardware). Each of the engines may include its own processor, but one processor may be used by all the modules. For example, each of the engines may include a processor and memory. Alternatively, one processor may execute the designated function of each of the modules. Further, the engines may be distributed across hardware and machine-readable storage mediums of a variety of devices.

The media weight determining system includes a resistance engine (234) to acquire the resistance of the fusing system (208). As described above, the resistance engine (234) may acquire the resistance value from memory stored in the imaging system (206) or stored on a consumable used with the imaging system (206).

The media weight determining system (230) includes an estimate engine (232) to estimate an input voltage at the fusing system (208). As described above, the input voltage is estimated based on a resistance of the fusing system (208) and a fusing system (208) temperature gradient. In performing such an estimation, the estimate engine (232) may rely on existing circuitry and may operate independent of a designated media weight sensor, or voltage sensor.

The media weight determining system (230) includes a duty ratio engine (240) that measures a duty ratio of the fusing system (208) over a defined period of time. The fusing energy engine (236) of the media weight determining system (230) determines a fusing energy per processed page based on the input voltage estimate, the fusing system (208) resistance, and the duty ratio of the fusing system (208). Specifically, with these numbers available, the fusing energy engine (208) determines an amount of power used to heat the printing compound/media, i.e., to fuse toner to an individual page of media or to evaporate a certain amount of moisture away from a page of media, as calculated over a time interval. As the determination of fusing energy per page is determined over time, the media weight determining system (230) may include a timing engine to determine an entry and exit time for sheets of media, such that a per page determination of fusing energy can be calculated.

The media weight engine (238) then determines a media weight based on the fusing energy per processed page. In some cases, doing so by consulting a lookup table stored in a database. The database may include a number of lookup tables, each defined by a set of environmental and/or initial conditions. For example, one lookup table may correspond to a first initial temperature at a certain relative humidity and a second lookup table may correspond to a second initial temperature at a different or same relative humidity. The media weight engine (238) may output a media weight value that overrides any user input media weight. For example, as described above, a user may incorrectly specify a media weight, or may fail to account for a change in media used, which could lead to the above-mentioned complications. Accordingly, the media weight engine (238) output may override any user input, thus ensuring accuracy in media weight determination.

In some examples, the media weight determining system (230) operates while the imaging device (210) is operating at full speed. That is, a determination as to media weight can be made while the associated job is being processed. In this case, the media weight estimate may continually be updated as the image processing is ongoing. In some cases, the determination of media weight may be made after a certain number of pages have been processed, for example 4-5 pages. Doing so ensures that the fuser roller (226) is at a constant temperature. For example, during initialization, the fuser roller (226) acts as a heat sink drawing power that would otherwise be used to heat the printing compound/media. Accordingly, by waiting until a few pages have been processed, it can be assured that the determination of fuser energy and the estimation of input voltage is more accurate. Doing so allows for high-speed media weight determination and avoids reducing print speed to effectuate media weight determination. Otherwise, the job would be slowed while a media weight determined, which negatively impacts productivity of the imaging system (206).

FIG. 3 is a flowchart of a method (300) for determining media weight based on an estimate of a fusing system input voltage, according to another example of the principles described herein. According to the method, a fusing system (FIG. 2, 208) resistance is acquired (block 301), an input voltage is estimated (block 302), and a duty ratio for the fusing system (FIG. 2, 208) is measured (block 303). These operations may be performed as described above in connection with FIG. 1.

A fusing energy per processed page is determined (block 304) based on the acquired and estimated parameters and a media weight determined (block 305) based on the fusing energy per processed page. Both of these operations may be performed as described above in connection with FIG. 1. Then, an operation of an imaging system (FIG. 2, 206) may be adjusted (block 306). Specifically, an operation of the imaging system (FIG. 2, 206) that generated a processed page may be adjusted. Such adjustments may be made to adjust the fusing parameters of the imaging system (FIG. 2, 206) to more accurately, and effectively, fuse toner to the media. For example, the temperature of the fuser roller (FIG. 2, 226) could be adjusted, the pressure between the fuser roller (FIG. 2, 226) and the pressure roller (FIG. 2, 228) could be adjusted, or the transport speed of the media through the fusing system (FIG. 2, 208) could be adjusted. In addition to adjusting these parameters a color table relied on by the imaging system (FIG. 2, 206) may be adjusted. Such adjustment may change the emphasis of certain colors whose properties shift based on media weight. Adjusting the transport speed effects the amount of time that the media is disposed between the nip and therefore exposed to the higher temperature and/or pressure.

Figure 4:
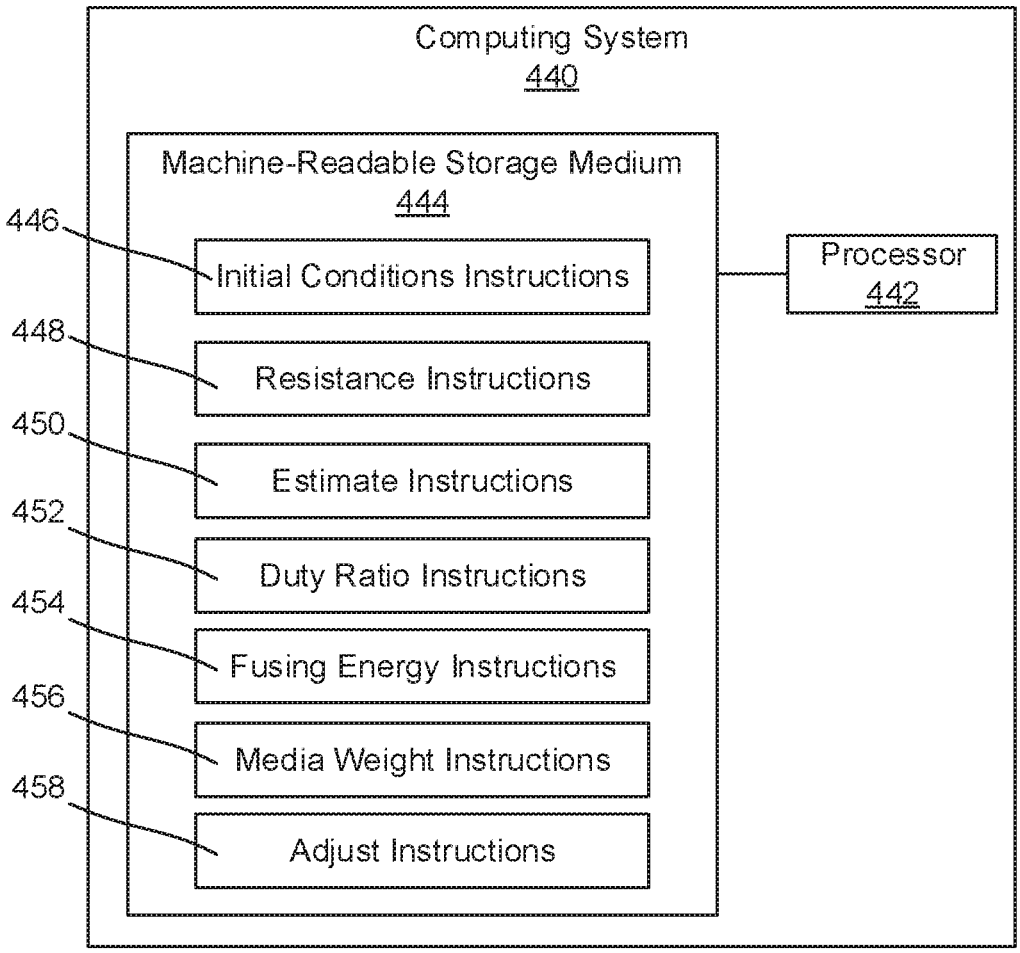
FIG. 4 is a diagram of a computing system to determine media weight based on an estimate of a fusing system input voltage, according to an example of the principles described herein.

FIG. 4 is a diagram of a computing system (440) to determine media weight based on an estimate of a fusing system input voltage, according to an example of the principles described herein. To achieve its desired functionality, the computing system (440) includes various hardware components. Specifically, the computing system (440) includes a processor (442) and a machine-readable storage medium (444). The machine-readable storage medium (444) is communicatively coupled to the processor (442). The machine-readable storage medium (444) includes a number of instruction sets (446, 448, 450, 452, 454, 456, 458) for performing a designated function. The machine-readable storage medium (444) causes the processor (442) to execute the designated function of the instruction sets (446, 448, 450, 452, 454, 456, 458).

Although the following descriptions refer to a single processor (442) and a single machine-readable storage medium (444), the descriptions may also apply to a computing system (440) with multiple processors and multiple machine-readable storage mediums. In such examples, the instruction sets (446, 448, 450, 452, 454, 456, 458) may be distributed (e.g., stored) across multiple machine-readable storage mediums and the instructions may be distributed (e.g., executed by) across multiple processors.

The processor (442) may include at least one processor and other resources used to process programmed instructions. For example, the processor (442) may be a number of central processing units (CPUs), microprocessors, and/or other hardware devices suitable for retrieval and execution of instructions stored in machine-readable storage medium (444). In the computing system (440) depicted in FIG. 4, the processor (442) may fetch, decode, and execute instructions (446, 448, 450, 452, 454, 456, 458) for controlling a media weight determining system (FIG. 2, 230). In one example, the processor (442) may include a number of electronic circuits comprising a number of electronic components for performing the functionality of a number of the instructions in the machine-readable storage medium (444). With respect to the executable instruction, representations (e.g., boxes) described and shown herein, it should be understood that part or all of the executable instructions and/or electronic circuits included within one box may, in alternate examples, be included in a different box shown in the figures or in a different box not shown.

The machine-readable storage medium (444) represent generally any memory capable of storing data such as programmed instructions or data structures used by the computing system (440). The machine-readable storage medium (444) includes a machine-readable storage medium that contains machine-readable program code to cause tasks to be executed by the processor (442). The machine-readable storage medium (444) may be tangible and/or non-transitory storage medium. The machine-readable storage medium (444) may be any appropriate storage medium that is not a transmission storage medium. For example, the machine-readable storage medium (444) may be any electronic, magnetic, optical, or other physical storage device that stores executable instructions. Thus, machine-readable storage medium (444) may be, for example, Random Access Memory (RAM), a storage drive, an optical disc, and the like. The machine-readable storage medium (444) may be disposed within the computing system (440), as shown in FIG. 4. In this situation, the executable instructions may be "installed" on the computing system (440). In one example, the machine-readable storage medium (444) may be a portable, external or remote storage medium, for example, that allows the computing system (440) to download the instructions from the portable/external/remote storage medium. In this situation, the executable instructions may be part of an "installation package". As described herein, the machine-readable storage medium (444) may be encoded with executable instructions for determining media weight.

Referring to FIG. 4, initial conditions instructions (446), when executed by a processor (442), may cause the computing system (440) to acquire initial conditions of the fusing system (FIG. 2, 208). Resistance instructions (448), when executed by a processor (442), may cause the computing system (440) to acquire a fusing system (FIG. 2, 208) resistance. Estimate instructions (450), when executed by a processor (442), may cause the computing system (440) to estimate a voltage applied to the fusing system (FIG. 2, 208) based on a portion of power passed to the fusing system (FIG. 2, 208) and a rate of change of temperature of the fusing system (FIG. 2, 208). In some examples, estimating a voltage applied to the fusing system (FIG. 2, 208) occurs before the printing compound is transferred to the media. For example, such an estimation may occur during a calibration stage that is prior to processing. Such a calibration stage can be executed various times over the life of an imaging system (FIG. 2, 206) such as upon first initialization, and can be repeated any number of times for example after a certain amount of processed pages, or after a predetermined period of time.

Duty ratio instructions (452), when executed by a processor (442), may cause the computing system (440) to measure a duty ratio of the fusing system (FIG. 2, 208). Fusing energy instructions (454), when executed by a processor (442), may cause the computing system (440) to determine a fusing energy per processed page based on the voltage applied to the fusing system (FIG. 2, 208), the fusing system (FIG. 2, 208) resistance, the duty ratio of the fusing system (FIG. 2, 208), and the initial conditions of the fusing system (FIG. 2, 208). Media weight instructions (456), when executed by a processor (442), may cause the computing system (440) to determine a media weight based on the fusing energy per processed page. Adjust instructions (458), when executed by a processor (442), may cause the computing system (440) to adjust an operation of a fusing system based on the determined media weight.

In some examples, acquiring a fusing system resistance, measuring a duty ratio, determining a fusing energy, determining a media weight, and adjusting an operation of the fusing system may occur during a print job. That is such media weight determining operations can be carried out simultaneously as printing such that printing is not impacted by any media weight determining operations. In this example, these operations can be performed after a predetermined number of sheets of the print job have been processed. This is to ensure that the fuser roller (FIG. 2, 226) is at a steady state temperature prior to determining media weight. Otherwise, a rising fuser roller (FIG. 2, 226) temperature could lead to inaccurate determination of fusing energy per page and consequently, an incorrect media weight determination.

In some examples, the processor (442) and machine-readable storage medium (444) are located within the same physical component, such as a server, or a network component. The machine-readable storage medium (444) may be part of the physical component's main memory, caches, registers, non-volatile memory, or elsewhere in the physical component's memory hierarchy. In one example, the machine-readable storage medium (444) may be in communication with the processor (442) over a network. Thus, the computing system (440) may be implemented on a user device, on a server, on a collection of servers, or combinations thereof.

The computing system (440) of FIG. 4 may be part of a general-purpose computer. However, in some examples, the computing system (440) is part of an application specific integrated circuit.

In one example, using such a media weight determining tool 1) determines media weight using existing sensors and control systems; 2) reduces the cost of media weight determination; 3) facilitates accurate media weight determination across a variety of printer models; 4) determines media weight at a faster rate; 5) minimizes energy consumption by providing fusing parameters tailored to the specific media weight present; 6) reduces the propensity of media wrap jams around the fuser roller; 7) reduces warranty expense resulting from complications arising from incorrect media weight measurements; 8) ensure proper configuration of imaging systems to accommodate an actual media weight processed, even in light of incorrect user indication; and 9) facilitates media weight determination at full printing speed. However, it is contemplated that the devices disclosed herein may address other matters and deficiencies in a number of technical areas.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general-purpose computer, special purpose computer, or other programmable data processing apparatus to produce a machine, such that the computer usable program code, when executed via, for example, the processor (442) of the computing system (440) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The preceding description has been presented to illustrate and describe examples of the principles described. This description is not intended to be exhaustive or to limit these principles to any precise form disclosed. Many modifications and variations are possible in light of the above teaching.

What is claimed is:

1. A method comprising:

acquiring a fusing system resistance;

estimating an input voltage of the fusing system, the input voltage being estimated based on a temperature response of the fusing system to a predetermined power applied to the fusing system;

measuring a duty ratio of the fusing system;

determining a fusing energy per processed page based on the estimated input voltage, the fusing system resistance, and the duty ratio of the fusing system; and determining a media weight based on the fusing energy per processed page.

2. The method of claim 1, further comprising adjusting an operation of the fusing system based on a determined media weight.

3. The method of claim 2, wherein adjusting an operation of the fusing system comprises adjusting a fusing temperature.

4. The method of claim 2, wherein adjusting an operation of the fusing system comprises adjusting a transport speed of media through the fusing system.

5. The method of claim 1, wherein the fusing energy per processed page is further based on environmental conditions of the fusing system.

6. The method of claim 1, wherein the fusing energy per processed page comprises an average fusing energy per processed page over a predetermined time interval.

7. An imaging system comprising:

an imaging device to form a printed mark on media by depositing printing compound on the media;

a fusing system to apply heat and pressure to the printing compound and the media; and a media weight determining system comprising:

a resistance engine to acquire a fusing system resistance;

an estimate engine to estimate an input voltage of the fusing system, the input voltage being estimated based on a temperature response of the fusing system to a predetermined power applied to the fusing system;

a duty ratio engine to measure a duty ratio of the fusing system;

a fusing energy engine to determine a fusing energy per processed page based on the estimated input voltage, the fusing system resistance, and the duty ratio of the fusing system; and a media weight engine to determine a media weight based on the fusing energy per processed page.

8. The system of claim 7, wherein the media weight determining system operates while the imaging device is operating at full speed.

9. The system of claim 7, wherein the media weight engine output overrides a user input media weight.

10. The system of claim 7, wherein the media weight is continuously updated as the imaging device is processing a job.

11. The system of claim 7, wherein the resistance engine acquires the fusing system resistance from a memory device in a toner consumable.

12. A computer system comprising:

a processor;

a machine-readable storage medium coupled to the processor; and an instruction set, the instruction set being stored in the machine-readable storage medium to be executed by the processor, wherein the instruction set comprises:

instructions to acquire initial conditions of a fusing system;

instructions to acquire a fusing system resistance;

instructions to estimate an input voltage of the fusing system, the input voltage being estimated based on a temperature response of the fusing system to a predetermined power applied to the fusing system;

instructions to measure a duty ratio of the fusing system;

instructions to determine a fusing energy per processed page based on the estimated input voltage, the fusing system resistance, the duty ratio of the fusing system, and the initial conditions;

instructions to determine a media weight based on the fusing energy per processed page; and instructions to adjust an operation of a fusing system based on the determined media weight.

13. The system of claim 12, wherein estimating the input voltage occurs before a printing compound is transferred to a media.

14. The system of claim 13, wherein acquiring a fusing system resistance, measuring a duty ratio of the fusing system, determining a fusing energy, and determining a media weight occur during a job.

15. The system of claim 13, wherein acquiring a fusing system resistance, measuring a duty ratio of the fusing system, determining a fusing energy, and determining a media weight occur after a predetermined number of sheets of a job have been processed.

* * * * *